US005245737A

United States Patent [19]

Perea

[11] Patent Number: 5,245,737

[45] Date of Patent: Sep. 21, 1993

[54] COTTER PIN EXTRACTOR KIT APPARATUS

[76] Inventor: Charles R. Perea, 1517 Osage Rd. SW., Alburquerque, N. Mex. 87105

[21] Appl. No.: 948,108

[22] Filed: Sep. 21, 1992

[51] Int. Cl.[5] ..... B25B 19/00

[52] U.S. Cl. ..... 29/247; 29/254

[58] Field of Search ..... 29/254, 255, 275, 247, 29/248; 173/90, 91; 81/463, 466

[56] References Cited

U.S. PATENT DOCUMENTS 1,403,919 1/1922 Seppmann ..... 29/247
1,518,068 12/1924 Horn ..... 29/247
1,597,159 8/1926 Johnson et al. ..... 29/247
1,707,842 4/1929 Buckle ..... 29/247
5,088,174 2/1992 Hull et al. ..... 29/254
5,109,739 5/1992 Hull et al. ..... 29/254

*Primary Examiner*—Robert C. Watson
*Attorney, Agent, or Firm*—Leon Gilden

[57] ABSTRACT

Elongate pull legs having shanks are arranged with hooks at their first distal ends and shank projecting second ends for reception within a slide hammer arrangement, wherein the hooks are arranged for grasping of cotter pins for their extraction.

3 Claims, 4 Drawing Sheets

COTTER PIN EXTRACTOR KIT APPARATUS

BACKGROUND OF THE INVENTION

1. Field of the Invention

The field of invention relates to cotter pin extraction tool structure, and more particularly pertains to a new and improved cotter pin extractor kit apparatus wherein the same is arranged for the grasping and removal of cotter pins utilizing an impact hammer structure.

2. Description of the Prior Art

Cotter pins as frequently used in the assemblage of various components together are frequently subject to deformation, corrosion, and the like, as well as being within recessed portions of structural components limiting access to such cotter pins for their removal. The instant invention attempts to overcome deficiencies of the prior art by providing a cotter pin tool structure arranged for access to and ease of removal of cotter pins.

The cotter pin removal structure as indicated in the U.S. Pat. No. 4,567,365 to Ward, et al. wherein cotter pin extracting pliers are arranged for removal of cotter pins. The pliers are functional but as noted, are limited by the nose structure of the pliers in their access to structure and further lack the impact removal aspect of the invention enhancing ease of removal of the cotter pin structure.

Accordingly, it may be appreciated there continues to be a need for a new and improved cotter pin extraction kit apparatus as set forth by the instant invention which addresses both the problems of ease of use as well as effectiveness in construction and in this respect, the present invention substantially fulfills this need.

SUMMARY OF THE INVENTION

In view of the foregoing disadvantage inherent in the known types of cotter pin tool apparatus now present in the prior art, the present invention provides a cotter pin extractor kit apparatus wherein the same is arranged to effect impact removal of cotter pins relative to their orientation. As such, the general purpose of the present invention, which will be described subsequently in greater detail, is to provide a new and improved cotter pin extractor kit apparatus which has all the advantages of the prior art cotter pin removal tool structure and none of the disadvantages.

To attain this, the present invention provides elongate pull legs having shanks arranged with hooks at their first distal ends and shank projecting second ends for reception within a slide hammer arrangement, wherein the hooks are arranged for grasping of cotter pins for their extraction.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cotter pin extractor kit apparatus which has all the advantages of the prior art cotter pin removal tool structure and none of the disadvantages.

It is another object of the present invention to provide a new and improved cotter pin extractor kit apparatus which may be easily and efficiently manufactured and marketed.

It is a further object of the present invention to provide a new and improved cotter pin extractor kit apparatus which is of a durable and reliable construction.

An even further object of the present invention is to provide a new and improved cotter pin extractor kit apparatus which is susceptible of a low cost of manufacture with regard to both materials and labor, and which accordingly is then susceptible of low prices of sale to the consuming public, thereby making such cotter pin extractor kit apparatus economically available to the buying public.

Still yet another object of the present invention is to provide a new and improved cotter pin extractor kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic cross-sectional illustration of the guide pin structure utilized by the slide hammer cylinder of the hammer structure of FIG. 8.

DESCRIPTION OF THE PREFERRED EMBODIMENT

Figures 1, 2:
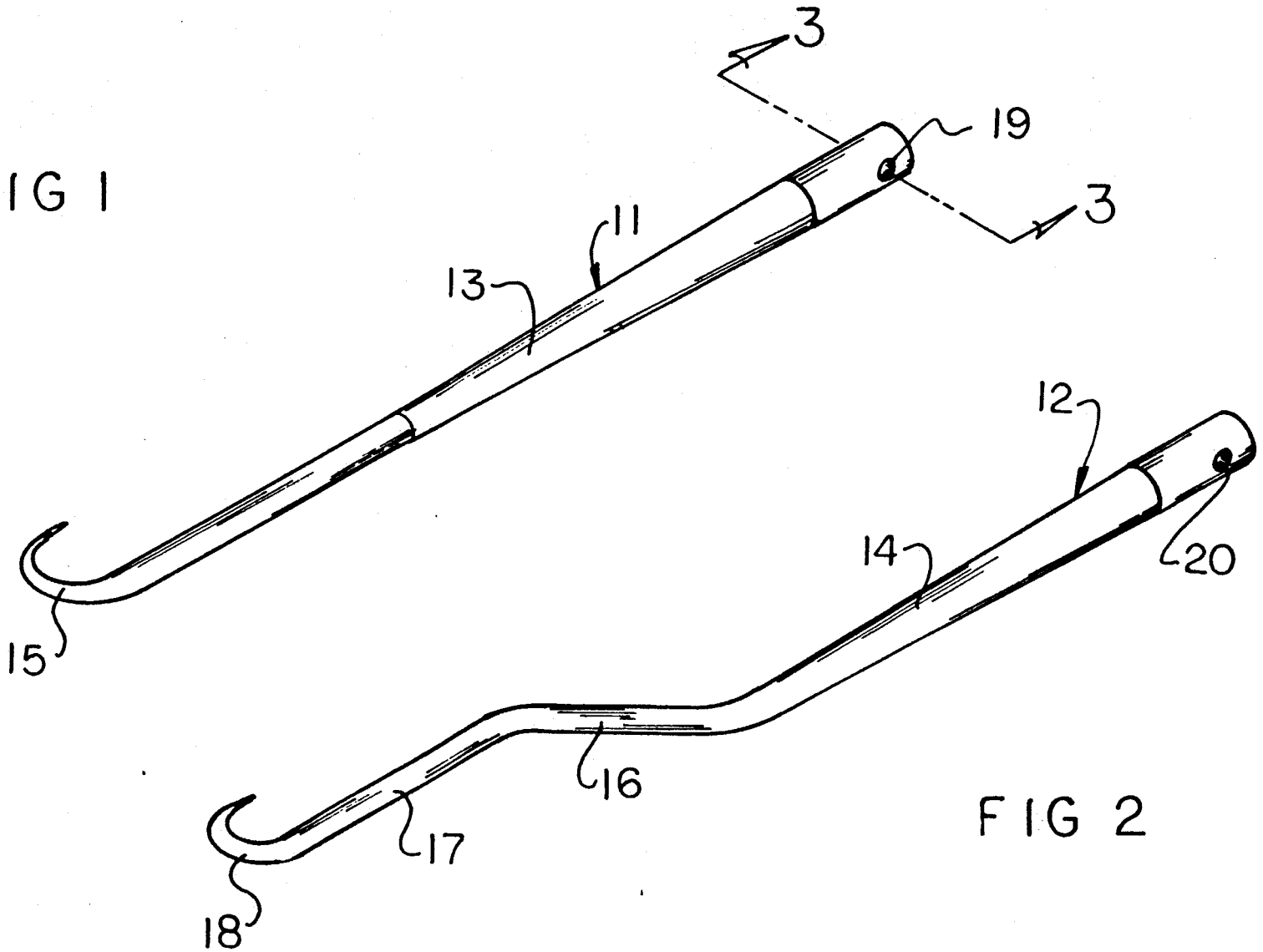
FIG. 1 is an isometric illustration of a first pull leg utilized by the invention.
FIG. 2 is an isometric illustration of a second pull leg utilized by the invention.
Figure 3:
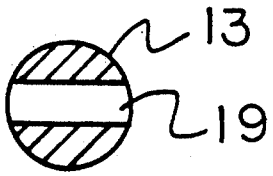
FIG. 3 is an orthographic view, taken along the lines 3—3 of FIG. 1 in the direction indicated by the arrows.
Figure 4:
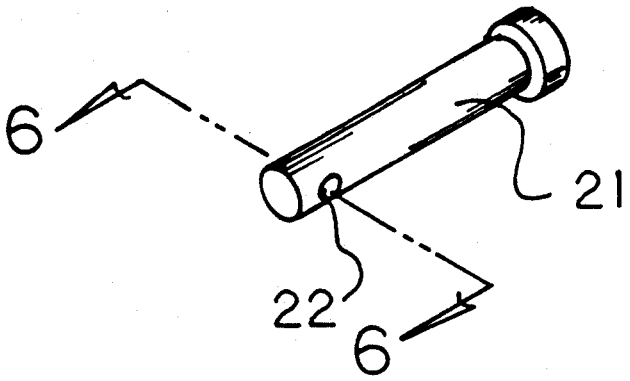
FIG. 4 is an isometric illustration of a lock pin structure utilized to secure a pull leg, as indicated in the FIGS. 1 and 2, relative to a slide hammer structure.
Figure 6:
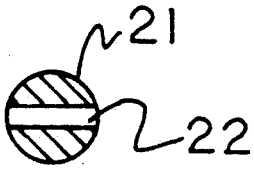
FIG. 6 is an orthographic view, taken along the lines 6—6 of FIG. 4 in the direction indicated by the arrows.
Figure 5:
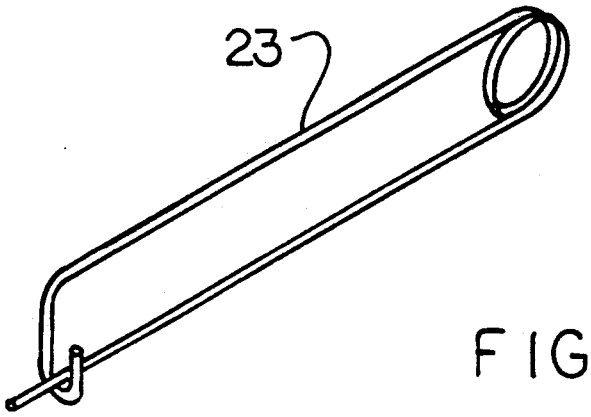
FIG. 5 is an isometric illustration of a locking clip utilized by the pin organization of FIG. 4.

With reference now to the drawings, and in particular to FIGS. 1 to 10 thereof, a new and improved cotter pin extractor kit apparatus embodying the principles and concepts of the present invention and generally designated by the reference numerals 11-35 will be described.

Figures 7, 7A:
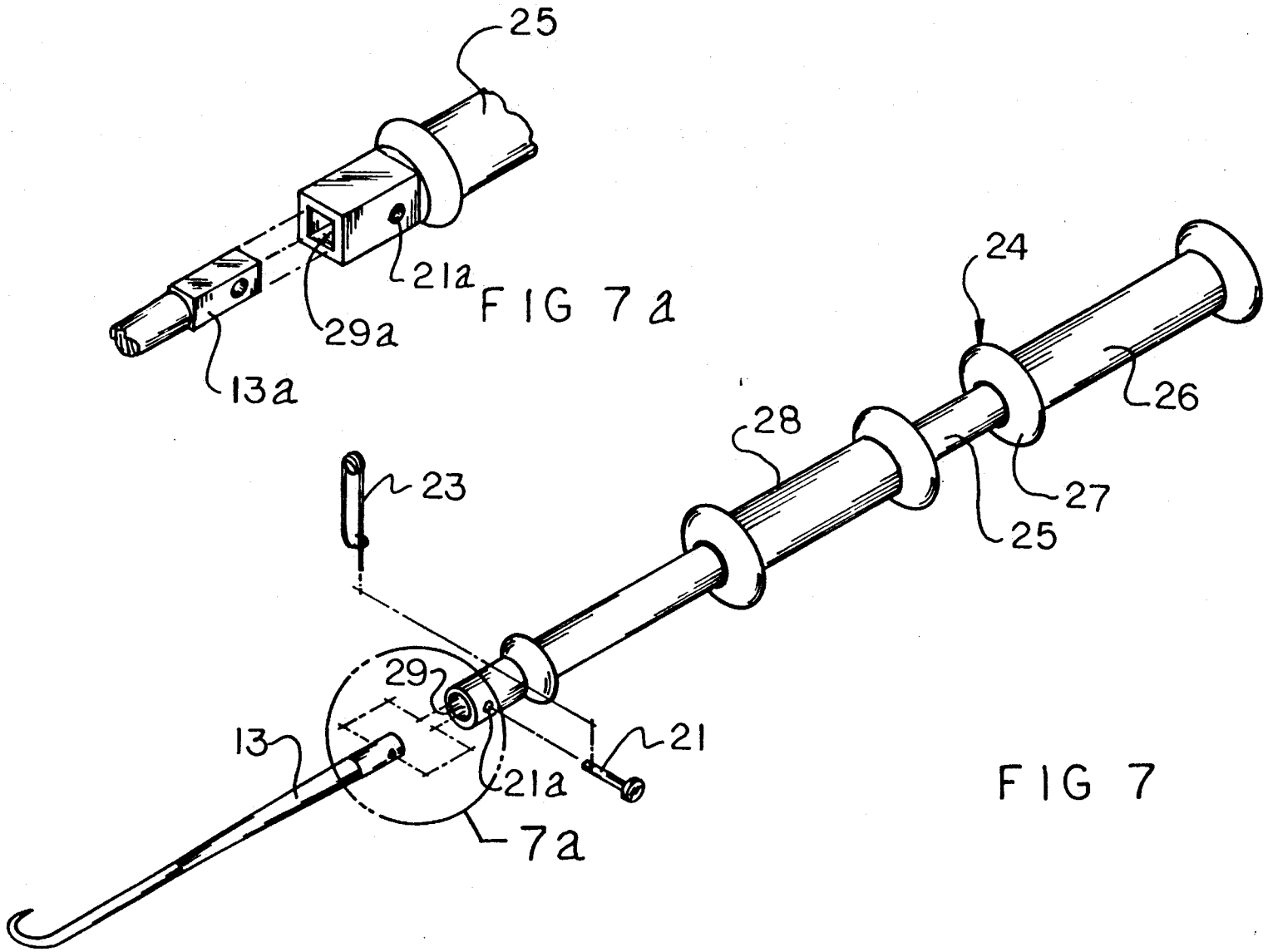
FIG. 7 is an isometric illustration of a slide hammer structure employed by the invention in association with a pull leg.
FIG. 7*a* is an isometric illustration of a pull leg employing a parallelepiped head for reception within a parallelepiped socket of the slide hammer organization.
Figure 9:
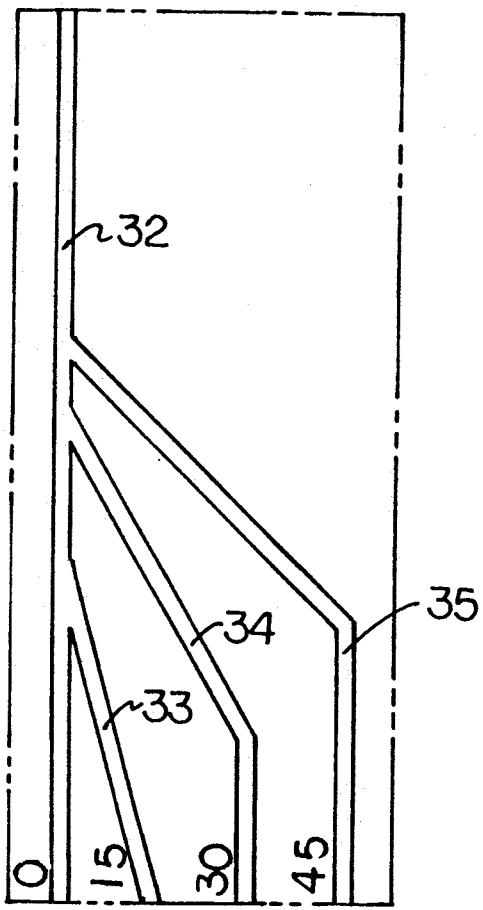
FIG. 9 is a plan view of the groove structure, as indicated in the slide hammer organization of FIG. 8.
Figure 8:
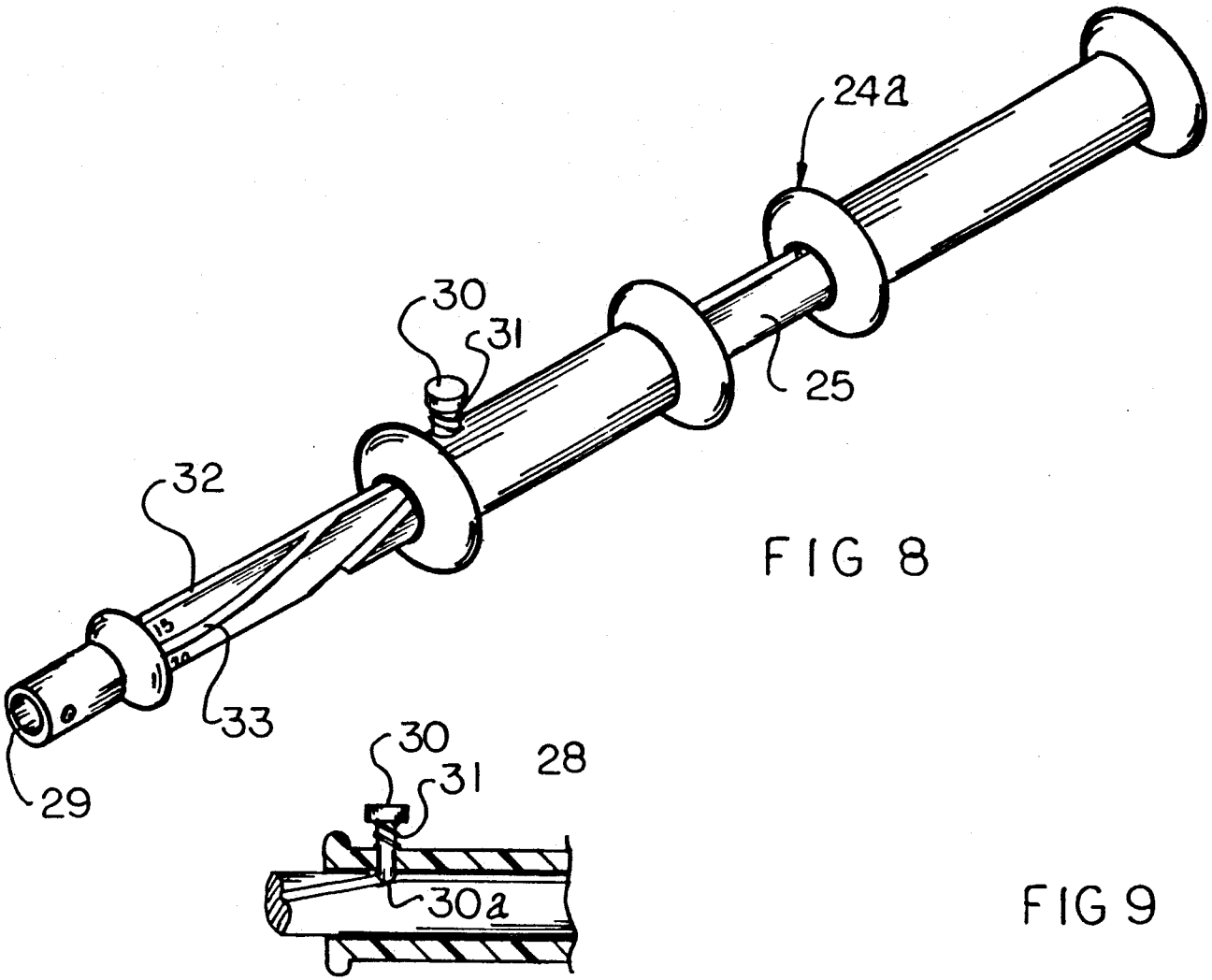
FIG. 8 is an isometric illustration of a modified pull hammer structure.

More specifically, the cotter pin extractor kit apparatus of the instant invention essentially comprises a first pull leg 11, a second pull leg 12, as indicated in FIGS. 1 and 2 respectively, cooperative with a slide hammer arrangement 24, as indicated in the FIG. 7, or a modified slide hammer 24*a*, as indicated in FIG. 8.

The second pull legs 11 and 12 respectively employ coaxially aligned elongate first and second leg shanks 13 and 14 of respective first and second length, wherein the second length of the second leg shank 14 is less than that of the first leg shank 13. As the first leg shank 13 includes a first leg hook member 15 at its second distal end spaced from its first distal end, which employs a first leg bore 19 orthogonally oriented relative to the axis of the first leg shank, the second leg shank includes a second intermediate shank 16 oriented at an oblique angle relative to the second leg shank 14 at its second distal end spaced from the second leg shank first distal end employing a second leg bore 20 that is in turn orthogonally oriented relative to the axis of the second leg shank 14. A forward shank 17 is oriented parallel to the second leg shank 14 in an offset relationship, having a second leg hook member 18 at the second distal end of the forward shank 17 as the first end of the forward shank 17 is integral with the intermediate shank 16. In this manner, the first and second pull legs 11 and 12 are arranged for reception within a slide hammer 24. The slide hammer 24 utilizes a lock pin bore 21*a* that is arranged to intersect a hammer shaft first end socket 29 to receive the second distal end of the first and second pull legs 11 and 12. The use of a lock pin 21 having a lock pin aperture 22 is provided as the lock pin 21 is directed through the lock pin bore 21*a*, as well as one of the respective first and second leg bores 19 and 20. A locking clip 23 is directed through the lock pin aperture 22 when the slide hammer and one of the pull legs are in assembled configuration. Alternatively, a parallelepiped pull leg head 13*a* for example may be employed for reception within a parallelepiped socket 29*a* in lieu of the hammer shaft first end socket 29 to further minimize potential rotation of a pull leg relative to the slide hammer structure.

The slide hammer 24 employs an elongate slide hammer shaft 25 that is longitudinally aligned, having a shaft handle 26 at a first end of the slide hammer shaft 25, with the hammer shaft socket directed into the second end of the hammer shaft 25. A handle abutment flange 27 is mounted in adjacency to a slide hammer cylinder 28 that is slidably directed along the shaft to effect impacting upon abutment of the slide hammer cylinder 28 with the handle abutment flange 27.

A modified shaft structure 25 is indicated in the FIG. 8 having respective first, second, third, and fourth grooves 32, 33, 34, and 35 respectively directed along the shaft in adjacency to the socket 29. The groove 32 is arranged parallel to the axis of the shaft 25, whereas the second, third, and fourth grooves are directed of a generally helical configuration along the surface of the shaft 25 intersecting the first groove 32 at displaced orientations relative to one another. In this manner, the slide hammer cylinder 28 is formed with a guide pin 30 that includes a follower end tip 30*a* directed into the central bore of the cylinder 28, as the follower tip 30*a* is guidably directed in one of the grooves 32-35 to effect selective twisting of the shaft 25 to effect simultaneous pull and rotation of the shaft in the removal of a cotter pin. In this manner, utilization of the first groove provides longitudinal movement of the shaft, while the position of one of the second through fourth grooves provides for selective rotation of the shaft to impart a rotative torque to the cotter pin to assist in its removal as required by an individual in use of the tool structure.

It should be noted that to position the follower tip 30*a* within one of the first through fourth grooves 32-35, a user of the organization merely lifts the guide pin and effects displacement of the follower tip relative to one of the grooves to permit ease of positioning of the follower tip within a selective groove of the first through fourth grooves to provide for a desired level of twist to the shaft 25 during use of the tool structure. The guide pin 30 is formed with a head structure mounting the spring 31 between the head structure and the slide hammer cylinder 28 to bias the follower tip into one of the grooves 32-35 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cotter pin extractor kit apparatus, comprising in combination, a first pull leg, a second pull leg, and a slide hammer, the first pull leg includes a first longitudinally aligned leg shank of a first length and first shank first end and a first shank second end, and the second pull leg includes an elongate second leg shank longitudinally aligned having a second shank first end and a second shank second end, wherein the second shank is of a second length less than the first length, and the first shank first end includes a first bore directed through the first shank orthogonally oriented relative to the first shank, and the second shank first end includes a second bore directed therethrough orthogonally oriented relative to the second shank, and the first shank first end includes a first hook member integral with the first shank, and the second shank first end includes an intermediate shank oriented at an oblique angle relative to the second leg shank, and the intermediate shank includes a forward shank integral to the intermediate shank and the forward shank is spaced from the second shank, with the forward shank arranged parallel to and offset relative to the second leg shank, wherein the forward shank includes a second hook member mounted to the forward shank spaced from the intermediate shank, and the slide hammer includes a slide hammer shaft, the slide hammer shaft having a first end, with the slide hammer shaft first end having a handle longitudinally aligned with the slide hammer shaft, and the handle including a handle abutment flange at an intersection of the slide hammer shaft and the handle, and the slide hammer shaft having a slide hammer shaft second end, and the slide hammer shaft second end including a second end socket to selectively receive the first pull leg and the second pull leg therewithin, with the slide hammer socket having a slide hammer socket aperture, wherein the slide hammer aperture is directed through the second end socket for alignment with the first bore and the second bore selectively, and a lock pin arranged for projection through the aperture and selectively the first bore and the second bore.

2. An apparatus as set forth in claim 1 wherein the slide hammer includes a slide hammer cylinder slidably mounted along the slide hammer shaft between the handle and the shaft second end, with the slide hammer cylinder having a slide hammer bore directed therethrough slidingly receiving the slide hammer shaft, and the slide hammer shaft having a first groove, and the slide hammer shaft symmetrically oriented about a shaft axis, and the first groove arranged parallel relative to the shaft axis, and a guide pin orthogonally directed through the slide hammer cylinder intersecting the slide hammer bore, and the guide pin having a follower tip directed into the guide pin bore and into the first groove, and the guide pin having a guide pin head positioned exteriorly of the slide hammer cylinder, and a spring member biasing the slide hammer head towards the slide hammer to effect biasing of the follower tip within the first groove.

3. An apparatus as set forth in claim 2 including at least a second groove, the second groove having a helical configuration along the slide hammer shaft intersecting the first groove for selective reception of the follower tip therewithin.

* * * * *